US007946056B2

(12) United States Patent
Kroll et al.

(10) Patent No.: US 7,946,056 B2
(45) Date of Patent: May 24, 2011

(54) AMBULATORY HAIRDRYER

(75) Inventors: Mollie B. Kroll, Minneapolis, MN (US); Mark W. Kroll, Crystal Bay, MN (US)

(73) Assignee: Kroll Family Trust, Crystal Bay, MN (US)

( * ) Notice: Subject to any disclaimer, the term of this patent is extended or adjusted under 35 U.S.C. 154(b) by 378 days.

(21) Appl. No.: 12/018,332

(22) Filed: Jan. 23, 2008

(65) Prior Publication Data

US 2009/0183383 A1 Jul. 23, 2009

(51) Int. Cl.
*F26B 21/06* (2006.01)

(52) U.S. Cl. ..... 34/96; 34/97; 34/100; 34/101; 34/104; 34/105; 62/259.3; 62/476; 705/1; 705/14; 428/138; 2/102; 132/233; 132/247

(58) Field of Classification Search ..... 34/96, 97, 34/100, 101, 104, 105; 62/259.3, 476; 132/233, 132/247; 2/102; 428/438; 705/1, 14
See application file for complete search history.

(56) References Cited

U.S. PATENT DOCUMENTS

| | | | | | |
|---|---|---|---|---|---|
| 2,008,864 | A | * | 7/1935 | Hamilton | 34/100 |
| 2,127,121 | A | | 8/1938 | Kelley | |
| 2,478,393 | A | * | 8/1949 | Haarman | 34/80 |
| 2,479,387 | A | * | 8/1949 | Matthews et al. | 34/562 |
| 2,479,388 | A | * | 8/1949 | Matthews et al. | 34/572 |
| 2,505,378 | A | * | 4/1950 | Belgau et al. | 96/144 |
| 2,773,313 | A | * | 12/1956 | O'Connor | 34/554 |
| 3,038,236 | A | * | 6/1962 | Breen | 442/200 |
| 3,038,237 | A | * | 6/1962 | Taylor, Jr. | 428/370 |
| 3,039,524 | A | * | 6/1962 | Belck et al. | 428/374 |
| 3,052,038 | A | * | 9/1962 | Harris | 34/80 |
| 3,068,587 | A | * | 12/1962 | Toellner | 34/554 |
| 3,108,862 | A | | 10/1963 | Toulmin | |
| 3,148,957 | A | * | 9/1964 | Ballard | 34/95.1 |
| 3,263,342 | A | * | 8/1966 | Giuffre | 34/76 |
| 3,264,705 | A | * | 8/1966 | Kovarik | 264/282 |
| 3,304,623 | A | * | 2/1967 | Reiss et al. | 34/80 |
| 3,377,715 | A | | 4/1968 | Hubner | |
| 3,391,470 | A | | 7/1968 | Chedister | |
| 3,417,481 | A | * | 12/1968 | Rumsey, Jr. | 34/72 |
| 3,431,917 | A | * | 3/1969 | Harris | 132/248 |
| 3,656,490 | A | * | 4/1972 | Grossman | 132/245 |
| 3,727,321 | A | | 4/1973 | Waters et al. | |
| 3,800,431 | A | | 4/1974 | Hubner | |
| 3,813,696 | A | | 6/1974 | Yeager | |
| 3,822,698 | A | | 7/1974 | Guy | |
| 3,884,543 | A | * | 5/1975 | McCachren | 439/453 |
| 3,888,252 | A | * | 6/1975 | Side et al. | 128/203.15 |
| 3,902,508 | A | * | 9/1975 | Sliman, Sr. | 132/226 |
| 3,923,697 | A | * | 12/1975 | Ellis | 252/506 |
| 3,946,498 | A | | 3/1976 | Waters et al. | |
| 3,972,126 | A | * | 8/1976 | DeMuro et al. | 34/283 |
| 3,999,040 | A | * | 12/1976 | Ellis | 219/543 |

(Continued)

FOREIGN PATENT DOCUMENTS

JP 62055247 A * 3/1987

(Continued)

*Primary Examiner* — Stephen M. Gravini
(74) *Attorney, Agent, or Firm* — Vidas, Arrett & Steinkraus, P.A.

(57) ABSTRACT

A portable self-contained hair drying helmet is taught that has thermal storage, desiccants, a phase change material, and thin lithium ion polymer batteries to allow one to dry their hair while walking around and performing personal and household duties.

11 Claims, 9 Drawing Sheets

HAIR DRYING METHOD

U.S. PATENT DOCUMENTS

| | | | | | |
|---|---|---|---|---|---|
| 4,038,759 | A | | 8/1977 | Dyer et al. | |
| 4,041,961 | A | * | 8/1977 | Shaler et al. | 132/245 |
| 4,064,074 | A | * | 12/1977 | Ellis | 252/506 |
| 4,146,933 | A | * | 4/1979 | Jenkins et al. | 2/458 |
| 4,164,951 | A | * | 8/1979 | Shaler et al. | 132/233 |
| 4,221,206 | A | * | 9/1980 | Haas | 123/198 DC |
| 4,384,411 | A | | 5/1983 | Stiegler et al. | |
| 4,419,835 | A | * | 12/1983 | Strain | 34/80 |
| 4,493,975 | A | | 1/1985 | Yamamoto | |
| 4,536,198 | A | * | 8/1985 | Strain | 95/125 |
| 4,615,883 | A | * | 10/1986 | Nelsen et al. | 424/84 |
| 4,654,057 | A | * | 3/1987 | Rhodes | 96/127 |
| 4,701,326 | A | * | 10/1987 | Nelsen et al. | 424/408 |
| 4,744,154 | A | | 5/1988 | Bollinger et al. | |
| 4,753,799 | A | * | 6/1988 | Nelsen et al. | 424/408 |
| 4,757,183 | A | * | 7/1988 | Karey et al. | 392/341 |
| 4,877,042 | A | * | 10/1989 | Downey | 132/212 |
| 4,903,503 | A | * | 2/1990 | Meckler | 62/238.3 |
| 4,987,748 | A | * | 1/1991 | Meckler | 62/176.1 |
| 5,031,579 | A | * | 7/1991 | Evans | 123/41.2 |
| 5,131,238 | A | * | 7/1992 | Meckler | 62/271 |
| 5,181,387 | A | * | 1/1993 | Meckler | 62/59 |
| 5,195,253 | A | | 3/1993 | Poumey et al. | |
| 5,251,623 | A | * | 10/1993 | Groux et al. | 607/50 |
| 5,289,695 | A | | 3/1994 | Parrish et al. | |
| 5,299,367 | A | * | 4/1994 | Johnson et al. | 34/95 |
| 5,327,919 | A | * | 7/1994 | Hanlon | 132/270 |
| 5,336,247 | A | * | 8/1994 | Groux et al. | 607/72 |
| 5,394,620 | A | * | 3/1995 | Chimera | 34/97 |
| 5,401,973 | A | * | 3/1995 | McKeown et al. | 250/492.3 |
| 5,434,420 | A | * | 7/1995 | McKeown et al. | 250/396 R |
| 5,451,794 | A | * | 9/1995 | McKeown et al. | 250/492.3 |
| 5,528,900 | A | * | 6/1996 | Prasad | 62/175 |
| 5,565,216 | A | * | 10/1996 | Cowsar et al. | 424/704 |
| 5,575,989 | A | * | 11/1996 | Caskey | 424/62 |
| 5,628,123 | A | * | 5/1997 | Chan | 34/90 |
| 5,640,781 | A | * | 6/1997 | Carson | 34/97 |
| 5,647,007 | A | | 7/1997 | Wooderson et al. | |
| 5,651,190 | A | | 7/1997 | Sanders | |
| 5,661,979 | A | * | 9/1997 | DeBoer | 62/3.6 |
| 5,711,324 | A | * | 1/1998 | Johnson et al. | 132/252 |
| 5,773,289 | A | * | 6/1998 | Samulski et al. | 435/320.1 |
| 5,787,601 | A | | 8/1998 | Stelly | |
| 5,810,467 | A | | 9/1998 | Hurwitz | |
| 5,839,204 | A | * | 11/1998 | Cinque et al. | 34/97 |
| 5,839,205 | A | * | 11/1998 | Hung | 34/97 |
| 5,840,320 | A | * | 11/1998 | Odom | 424/401 |
| 5,857,262 | A | | 1/1999 | Bonnema et al. | |
| 5,857,470 | A | * | 1/1999 | Schmidt et al. | 132/211 |
| 5,868,105 | A | * | 2/1999 | Evans | 123/41.5 |
| 5,873,178 | A | * | 2/1999 | Johnson | 34/90 |
| 5,940,980 | A | | 8/1999 | Lee et al. | |
| 6,038,783 | A | | 3/2000 | McFadden | |
| 6,041,262 | A | * | 3/2000 | Beder | 607/139 |
| 6,053,132 | A | * | 4/2000 | Evans | 123/41.5 |
| 6,058,944 | A | | 5/2000 | Porter | |
| 6,109,874 | A | * | 8/2000 | Steiner et al. | 416/63 |
| 6,110,533 | A | | 8/2000 | Cote et al. | |
| 6,157,298 | A | | 12/2000 | Garfinkel et al. | |
| 6,199,558 | B1 | * | 3/2001 | Schmidt et al. | 132/211 |
| 6,242,076 | B1 | * | 6/2001 | Andriash | 428/138 |
| 6,332,097 | B1 | * | 12/2001 | Beder | 607/139 |
| 6,358,272 | B1 | * | 3/2002 | Wilden | 607/89 |
| 6,476,509 | B1 | * | 11/2002 | Chen et al. | 290/1 R |
| 6,513,339 | B1 | * | 2/2003 | Kopko | 62/94 |
| 6,516,656 | B1 | * | 2/2003 | Jetter et al. | 73/114.71 |
| 6,531,230 | B1 | * | 3/2003 | Weber et al. | 428/480 |
| 6,553,687 | B1 | * | 4/2003 | Leamon, Jr. | 34/104 |
| 6,557,369 | B1 | * | 5/2003 | Phelps et al. | 62/457.5 |
| 6,557,459 | B1 | * | 5/2003 | Phelps et al. | 99/323.1 |
| 6,560,784 | B2 | * | 5/2003 | Hill | 2/171 |
| 6,607,100 | B2 | * | 8/2003 | Phelps et al. | 222/152 |
| 6,607,105 | B2 | * | 8/2003 | Phelps et al. | 222/400.8 |
| 6,658,859 | B2 | * | 12/2003 | Phelps et al. | 62/3.6 |
| 6,756,764 | B2 | * | 6/2004 | Smith et al. | 320/105 |
| 6,782,636 | B2 | * | 8/2004 | Feldman | 34/96 |
| 6,797,366 | B2 | * | 9/2004 | Hanson et al. | 428/201 |
| 6,913,167 | B2 | * | 7/2005 | Phelps et al. | 222/152 |
| 6,964,116 | B2 | | 11/2005 | Kroll et al. | |
| 6,973,931 | B1 | * | 12/2005 | King | 132/212 |
| 6,977,722 | B2 | * | 12/2005 | Wohlstadter et al. | 356/246 |
| 7,017,590 | B2 | * | 3/2006 | Mackinder | 132/233 |
| 7,022,283 | B2 | * | 4/2006 | McGuire et al. | 422/40 |
| 7,087,710 | B2 | * | 8/2006 | Medsker et al. | 528/402 |
| 7,118,608 | B2 | * | 10/2006 | Lovell | 55/385.1 |
| 7,130,719 | B2 | * | 10/2006 | Ehlers et al. | 700/276 |
| 7,138,173 | B2 | * | 11/2006 | Wheatley et al. | 428/212 |
| 7,287,533 | B2 | * | 10/2007 | Mackinder | 132/233 |
| 7,334,585 | B2 | * | 2/2008 | Anzevino | 132/247 |
| 7,343,226 | B2 | * | 3/2008 | Ehlers et al. | 700/276 |
| 7,379,997 | B2 | * | 5/2008 | Ehlers et al. | 709/224 |
| 7,381,105 | B2 | * | 6/2008 | Miekka | 439/886 |
| 7,418,428 | B2 | * | 8/2008 | Ehlers et al. | 705/63 |
| 7,516,106 | B2 | * | 4/2009 | Ehlers et al. | 705/412 |
| 7,716,940 | B2 | * | 5/2010 | Farnworth et al. | 62/259.3 |
| 7,842,246 | B2 | * | 11/2010 | Wohlstadter et al. | 422/401 |
| 7,851,054 | B2 | * | 12/2010 | Weber et al. | 428/220 |
| 2002/0104150 | A1 | * | 8/2002 | Hill | 2/174 |
| 2002/0121877 | A1 | * | 9/2002 | Smith et al. | 320/103 |
| 2003/0029185 | A1 | * | 2/2003 | Kopko | 62/271 |
| 2003/0035972 | A1 | * | 2/2003 | Hanson et al. | 428/480 |
| 2003/0098314 | A1 | * | 5/2003 | Phelps et al. | 222/1 |
| 2003/0098320 | A1 | * | 5/2003 | Phelps et al. | 222/400.7 |
| 2003/0145606 | A1 | * | 8/2003 | Phelps et al. | 62/3.6 |
| 2003/0163930 | A1 | * | 9/2003 | Feldman | 34/96 |
| 2003/0177912 | A1 | * | 9/2003 | McGuire et al. | 99/323 |
| 2003/0213814 | A1 | * | 11/2003 | Phelps et al. | 222/146.6 |
| 2004/0022677 | A1 | * | 2/2004 | Wohlstadter et al. | 422/52 |
| 2004/0031282 | A1 | * | 2/2004 | Kopko | 62/271 |
| 2004/0103553 | A1 | * | 6/2004 | Kroll et al. | 34/96 |
| 2004/0117330 | A1 | * | 6/2004 | Ehlers et al. | 705/412 |
| 2004/0133314 | A1 | * | 7/2004 | Ehlers et al. | 700/276 |
| 2004/0138981 | A1 | * | 7/2004 | Ehlers et al. | 705/36 |
| 2004/0139038 | A1 | * | 7/2004 | Ehlers et al. | 705/412 |
| 2004/0163289 | A1 | * | 8/2004 | Pearson | 40/584 |
| 2004/0250830 | A1 | * | 12/2004 | Mackinder | 132/233 |
| 2005/0033707 | A1 | * | 2/2005 | Ehlers et al. | 705/412 |
| 2005/0052646 | A1 | * | 3/2005 | Wohlstadter et al. | 356/311 |
| 2005/0079333 | A1 | * | 4/2005 | Wheatley et al. | 428/212 |
| 2005/0142033 | A1 | * | 6/2005 | Glezer et al. | 422/58 |
| 2005/0150244 | A1 | | 7/2005 | Hillmann et al. | |
| 2005/0205106 | A1 | * | 9/2005 | Mackinder | 132/233 |
| 2005/0223902 | A1 | * | 10/2005 | Lovell | 96/134 |
| 2005/0229425 | A1 | | 10/2005 | Kroll et al. | |
| 2005/0269312 | A1 | * | 12/2005 | Gerhardinger | 219/543 |
| 2006/0005852 | A1 | * | 1/2006 | Mackinder | 132/233 |
| 2006/0027482 | A1 | * | 2/2006 | Pearson | 206/702 |
| 2006/0042649 | A1 | * | 3/2006 | Anzevino | 132/247 |
| 2006/0057213 | A1 | * | 3/2006 | Larhrib et al. | 424/489 |
| 2006/0174392 | A1 | * | 8/2006 | Farnworth et al. | 2/102 |
| 2006/0180647 | A1 | * | 8/2006 | Hansen | 235/375 |
| 2006/0248660 | A1 | * | 11/2006 | Ryan et al. | 8/405 |
| 2006/0281435 | A1 | * | 12/2006 | Shearer et al. | 455/343.1 |
| 2007/0043477 | A1 | * | 2/2007 | Ehlers et al. | 700/276 |
| 2007/0043478 | A1 | * | 2/2007 | Ehlers et al. | 700/276 |
| 2007/0090387 | A1 | * | 4/2007 | Daniels et al. | 257/99 |
| 2007/0091614 | A1 | * | 4/2007 | Kaisser et al. | 362/326 |
| 2007/0101604 | A1 | * | 5/2007 | Brazier | 34/96 |
| 2007/0102280 | A1 | * | 5/2007 | Hunter et al. | 204/157.15 |
| 2007/0175234 | A1 | * | 8/2007 | Pruitt | 62/310 |
| 2007/0178777 | A1 | * | 8/2007 | Miekka | 439/886 |
| 2007/0184274 | A1 | * | 8/2007 | Wheatley et al. | 428/411.1 |
| 2007/0193132 | A1 | * | 8/2007 | Roscioli | 52/169.6 |
| 2007/0266586 | A1 | * | 11/2007 | Behbehani | 34/90 |
| 2007/0286928 | A1 | * | 12/2007 | Sarmas et al. | 426/106 |
| 2008/0017045 | A1 | * | 1/2008 | McGuire | 99/323 |
| 2008/0103415 | A1 | * | 5/2008 | Roe et al. | 600/583 |
| 2008/0125835 | A1 | * | 5/2008 | Laurent | 607/89 |
| 2008/0169910 | A1 | * | 7/2008 | Greene et al. | 340/10.34 |
| 2009/0004047 | A1 | * | 1/2009 | Hunter et al. | 422/4 |
| 2009/0093361 | A1 | * | 4/2009 | Sakatani et al. | 502/309 |
| 2009/0102296 | A1 | * | 4/2009 | Greene et al. | 307/149 |
| 2009/0130745 | A1 | * | 5/2009 | Williams et al. | 435/287.2 |
| 2009/0148342 | A1 | * | 6/2009 | Bromberg et al. | 422/37 |
| 2009/0157529 | A1 | * | 6/2009 | Ehlers et al. | 705/26 |
| 2009/0183383 | A1 | * | 7/2009 | Kroll et al. | 34/99 |
| 2009/0221059 | A1 | * | 9/2009 | Williams et al. | 435/287.2 |

| | | | | |
|---|---|---|---|---|
| 2009/0229967 | A1* | 9/2009 | Sakatani | 204/157.3 |
| 2009/0323180 | A1* | 12/2009 | Weber et al. | 359/359 |
| 2010/0011663 | A1* | 1/2010 | Coyle | 48/127.3 |
| 2010/0084665 | A1* | 4/2010 | Daniels et al. | 257/88 |
| 2010/0090656 | A1* | 4/2010 | Shearer et al. | 320/139 |
| 2010/0106077 | A1* | 4/2010 | Rabin et al. | 604/20 |
| 2010/0196908 | A1* | 8/2010 | Opalsky et al. | 435/6 |
| 2011/0005267 | A1* | 1/2011 | Lambert et al. | 62/476 |

FOREIGN PATENT DOCUMENTS

| | | | | |
|---|---|---|---|---|
| JP | 11344239 | A | * | 12/1999 |
| JP | 2000093731 | A | * | 4/2000 |
| JP | 2001054488 | A | * | 2/2001 |
| JP | 2007024467 | A | * | 2/2007 |
| WO | WO 2005012624 | A1 | * | 2/2005 |

* cited by examiner

HAIR DRYING METHOD

RECOVERY METHOD

AMBULATORY HAIRDRYER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

Many people spend a half an hour in the morning to dry their hair. This is non-productive time, which must be spent with a hairdryer in one hand. Thus there is need for a portable hair dryer that would dry the hair while the person is able to perform other morning duties. Several such devices have been patented already. The portable hairdryer of Waters (U.S. Pat. No. 3,946,498) is a unit that hangs on the head, and is powered by a long extension cord. The cordless drier of Tomay (U.S. Pat. No. 5,195,253) teaches a handheld blower type dryer with both an electrical and thermal battery. This is also impractical since it requires the full time use of one hand.

The hands-free hair dryer of Sanders (U.S. Pat. No. 5,651,190) teaches a hair bonnet connected by a flexible hose to a battery pack worn on the back. This is not very practical for a number of reasons. The hose would interfere with many activities, and the heavy battery requires a strap to be attached to the body. And lastly, the battery's longevity is very limited. Consider the worst-case example and assume that one needs to have the dryer at 1500 watts for 30 minutes. This equates to a total energy use of 2.7 megajoules. If this was powered by a 12 volt battery this would require a total charge of 225 coulombs. This is equivalent to 62.5 ampere hours (Ah), which is the capacity of a large conventional car battery. Thus the battery-operated devices have not proven practical. Similarly, the portable hair dryer of Stelly (U.S. Pat. No. 5,787,601) with a rechargeable battery pack has not proven practical, presumably because of the extreme weights required for conventional hair-drying.

The portable hair dryer of Bonnema (U.S. Pat. No. 5,857,262) is a gas-powered drier. While this will presumably store enough energy for a full cycle of drying as hydrocarbons are highly efficient energy storage units, this would still require the use of a hand to hold and control the dryer.

The hands-free dryer of Lee et al. (U.S. Pat. No. 5,940,980) is essentially a conventional hand-held drier attached to a gooseneck tubing, which is attached to a large clip for attachment to convenient furniture or fixtures. This again is not very practical as it requires a largely fixed position of the head with respect to the dryer.

Finally, the portable dryer of Porter (U.S. Pat. No. 6,058,944) teaches a bonnet and hose with a purse style hydrocarbon heater feeding the hot, dry air to the hose. This has some of the same limitations as some of the early devices in that it would require the carrying of the heater unit and the hose would be interfering with natural movements. In addition, the propane reservoir in the purse unit would have to be recharged on a regular basis.

Thus, in spite of the demonstrated need for a truly portable hair dryer no practical unit has been brought to the market.

Devices similar to the present invention are disclosed in application Ser. No. 11/150,938 filed Jun. 13, 2005, entitled "Ambulatory Hairdryer" and U.S. Pat. No. 6,964,116, filed Dec. 2, 2002, entitled "Ambulatory Hairdryer", the disclosures of each being incorporated herein by reference in their entirety.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. §1.72.

BRIEF SUMMARY OF THE INVENTION

The invention is a hair-drying helmet that is completely portable and ambulatory. The hair-drying helmet contains a built in battery to power a fan. It is another significant feature of this invention that the helmet has desiccant materials on the inside for passive drying of the hair. It is another significant feature of the invention that the helmet is made of a very high heat capacity polymer. It is another significant feature of this invention that the whole system of the helmet can be simply automatically regenerated by setting it on a stand, which is in turn powered from household energy sources. It is another significant feature of this invention that the multiple synergies between the thermal storage, dessicant drying, and low volume fan allow the use of small and practical batteries. It is another significant feature of this invention that the helmet contains a phase change thermal storage material.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
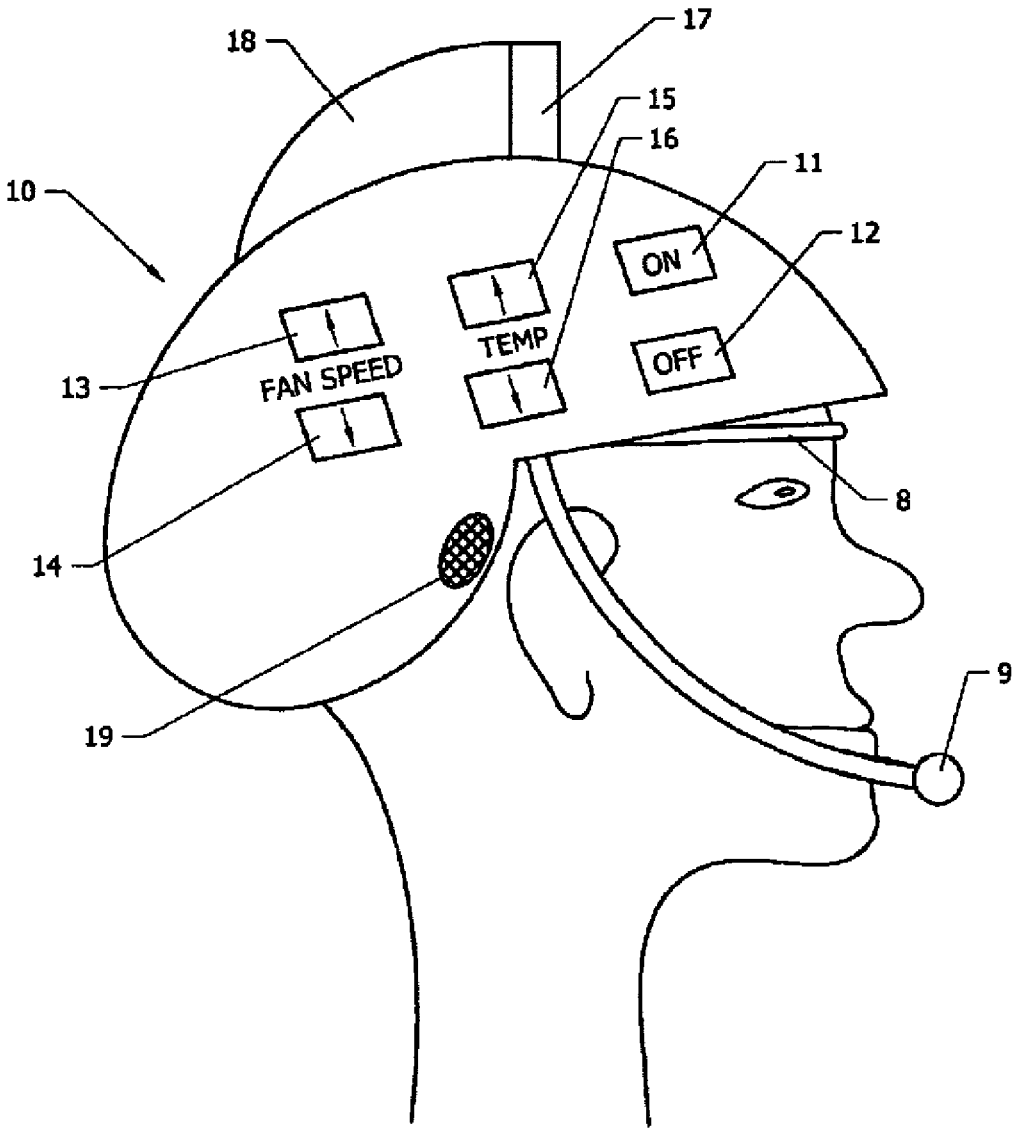
FIG. 1 shows a basic hair-drying helmet on the head of a user.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows the helmet 10 in use on the head of the user. Brow strap 8 holds it on the head. Microphone boom 9 allows for the user to answer telephone calls during the drying operation. On switch 11 and off switch 12 are used to turn the device on and off. Fan speed switches 13 and 14 are used to accelerate and decelerate the fan respectively. Temperature increase switch 15 and decrease switch 16 are used to adjust the temperature in the helmet.

Fan 17 is used to force air in from the outside and direct it down through channel 18 on to the head of the user. In an alternative embodiment, the helmet has multiple fans located around the upper half of the helmet.

A suitable fan is the MDS series DC axial flow fans from Oriental Motor USA Corp located at OrientalMotor.com. The smallest frame size at 1.65 square inches for input voltage of 12 VDC is appropriate for the design. In an alternative embodiment, a high voltage generator develops negative ions near the fan as negative ions speed the hair drying process.

Also shown is the optional small speaker 19 to allow the user to listen to the radio through direct FM reception. Alternatively this could be used for producing noise cancellation over the user's ear or with a Bluetooth connection to listen to the television or the user's stereo system. This speaker is also used in conjunction with the microphone 9 for telephone operation.

Figure 2:
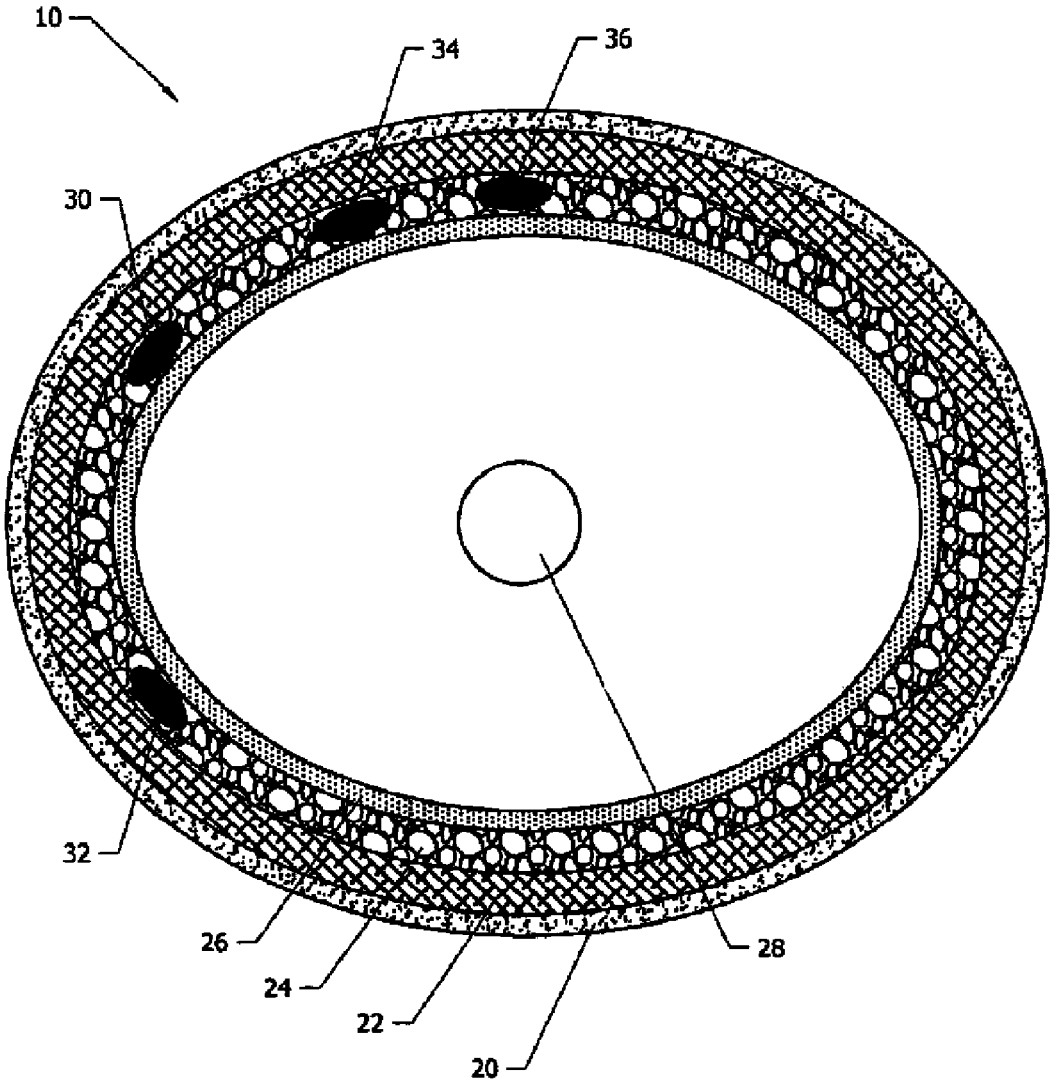
FIG. 2 shows a schematic bottom view of the helmet.

FIG. 2 shows a bottom view of the helmet 10. On the outside is a thin layer of thermal insulation 20. This could be any suitable plastic with a low thermal conductivity such as Dow Chemical company Styrofoam. Alternatively the outer layer is applied with a "soft-touch" overmolding process. Preferentially the soft touch overmolded material is polyetheramide, polyetherester, polyesterester, or styrene ethylbutylene styrene.

Just inside of that is the layer of a thermal storage material 22. One embodiment of a thermal storage material 22 is a phase change material (PCM), available from Entropy Solutions, Inc. of Minneapolis, Minn. (www.entropysolutionsinc.com). These PCMs have very high latent heat storage capabilities per unit volume. As such, they are capable of storing and releasing a large amount of energy as they transition between states. In this application, the only phase change of interest is that between solid and liquid states.

Referring to a solid-to-liquid phase change, when heat is applied to a PCM, the material will increase in temperature until the material reaches its melting temperature. At this point, the PCM is capable of continuing to absorb a large amount of heat without significantly increasing in temperature.

Temperatures comfortable to the human head are in the range of about 30° C. to about 61° C. As an example of a PCM that may be chosen as thermal storage material 22 is a PCM from Entropy Solutions, Inc. with a melting point of 56° C. This PCM has a latent heat of melting of about 251 J/g. Assume for purposes of this illustration that the layer of PCM is 4 mm thick and that the average radius of the helmet is 10 cm. Then the area of the half-shell helmet would be approximately 628 $cm^2$. Multiplying this by a 4 mm thickness gives an approximate volume of 251 ml. The density of the PCM is approximately 0.81 g/ml giving a total approximate mass of 203 g. The heat storage in the PCM, going from a preheated temperature 60° C. down to 30° C. (which temperatures are comfortable to the human head), would be 203 g×251 J/g, or approximately 51 kJ.

Another suitable PCM from Entropy Solutions, Inc. with a melting point of 61° C. may be chosen as a thermal storage material. The latent heat of melting for this PCM is about 205 J/g. Using the calculations from above, the heat storage in the PCM would be 203×205 J/g, or approximately 41 kJ.

Assume a blonde with long hair (blondes have the most hair, approximately 140,000 hairs on the head). The mass of the wet hair would be approximately 100 g. Approximately 8000 calories, or about 32 kJ, would be required to raise the temperature of the wet hair by almost 80° C. Thus, the energy stored in the phase change material on its own would be sufficient to raise the temperature of the wet hair by almost 80° C. Because of the limited temperature of the phase change material (to prevent burning) this would not be done alone but would rather be assisted by the heating elements.

The next layer 24 is a lithium polymer battery. Which battery has been announced by Caleb Technology Corporation located at Caleb-Battery.com. The battery is available in very thin sheets and can be wrapped inside and bonded to the helmet and is also rechargeable. The capacity is greater than 60 Ah/kg with an average lithium ion voltage of 3.8 V. The cycle life is over 1,000 charged cycles with an operating temperature range of up to 60° C. In fact, the lithium ion polymer batteries have excessive internal impedance at room temperature for many uses. They perform much better at 60° C. because the internal impedance is lowered significantly. Hence, there is an advantage of having the lithium ion polymer battery bonded directly to the phase change material. With 1 kg of battery built into the helmet the device would store 60 Ah×3.8 V=820,800 J. This would allow the continuous delivery of 456 watts=820,800 J/30 minutes/60 seconds per minute for the typical half hour drying cycle. This is not enough to power a full 1500 watt conventional blow dryer. But, due to the high efficiency design of the helmet it would be more than enough to completely dry the operator's head.

The next layer is the desiccant 26. This desiccant would be preferentially a mixture of silica gel and molecular sieve zeolite (sodium aluminal silicate). The advantage of the zeolite is it will hold 20% of its weight in moisture down to very low relative humidity. The advantage of the silica gel is that it will hold about 45% of its weight, but that drops down very quickly as the relative humidity goes to zero. Thus the preferred embodiment entails a combination of the two desiccants.

A suitable source for both desiccants is the Polylam Corporation located at polylam.com.

An alternative sophisticated desiccant is a cross linked polymeric desiccant such as that taught by Cote in U.S. Pat. No. 6,110,533 which is incorporated herein by reference.

The helmet top air port 28 as shown in the center of FIG. 2.

Electrode contacts 30 and 32 are located on the bottom of the helmet for recharging the battery. Electrode contacts 34 and 36 are also located in the bottom of the helmet to allow for contact to the capacitive humidity sensor, which is located in the base. Contacts 34 and 36 respectively mate with base contacts 52 and 53 shown in FIG. 3.

Only 220 grams of silica gel could absorb all of the 100 g of water in the wet hair. Due to the fact that half of the humidity will be dissipated in the exhaust air the desiccants really only need to store about 50 g of water. This would be divided between the zeolite and the silica gel so that the required total mass of desiccant would be about 100 g.

Figure 3:
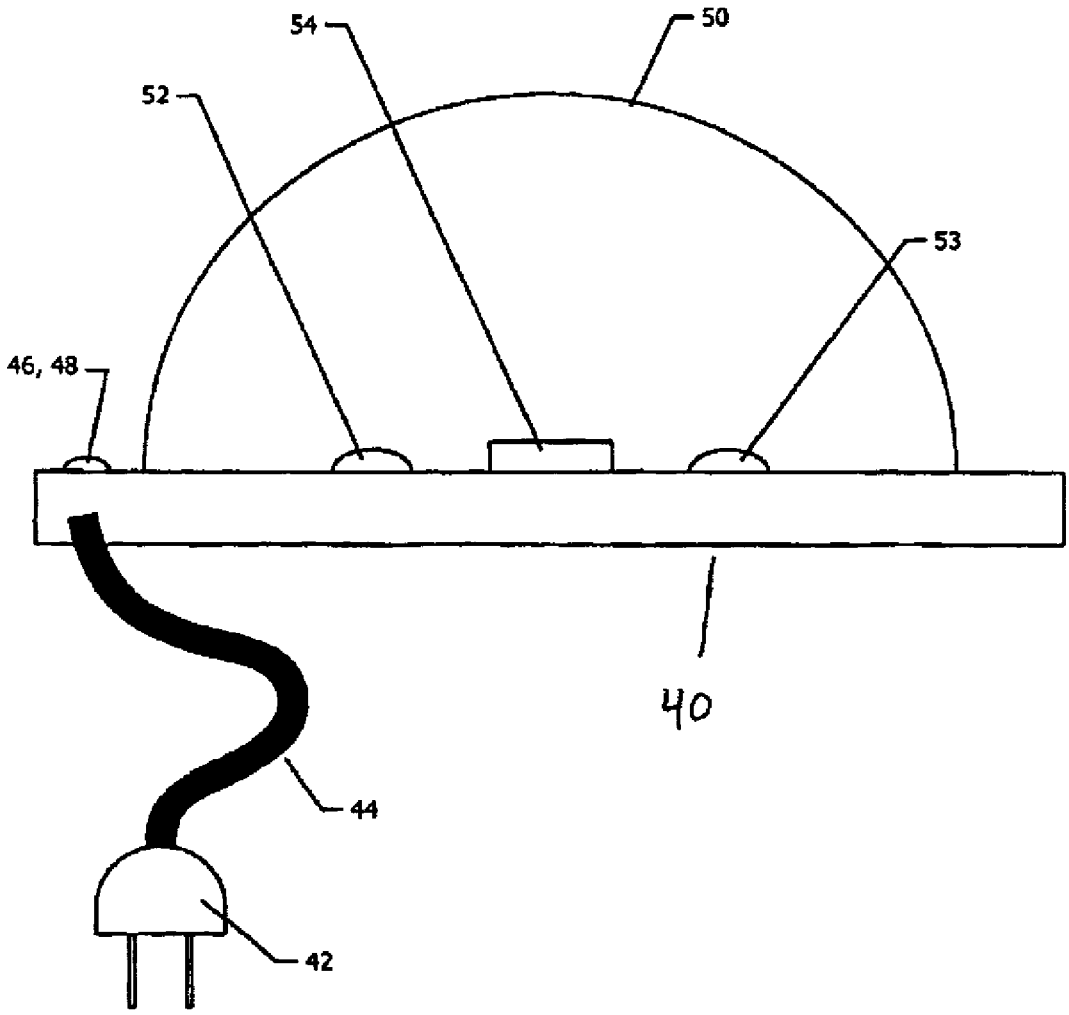
FIG. 3 shows a side view of the regenerating base station.

FIG. 3 shows the side view of the base regeneration station 40. Power cord plug 42 is plugged into the household electrical supply and provides current through cord 44 to the base unit 40. Pressure contacts 46 and 48 are designed to mate with contacts 30 and 32 on the helmet. Contacts 52 and 53 are connected to the capacitance humidity sensor 54. This allows the circuitry in the helmet to read the local air humidity during a regeneration phase. The dome 50 in the middle of base station 40 performs two functions. First it forces an accurate centering of the helmet so that the electrode contacts are aligned properly. Secondly, it forces the airflow to go through the sides of the helmet so as to recycle the desiccant.

Figure 3A:
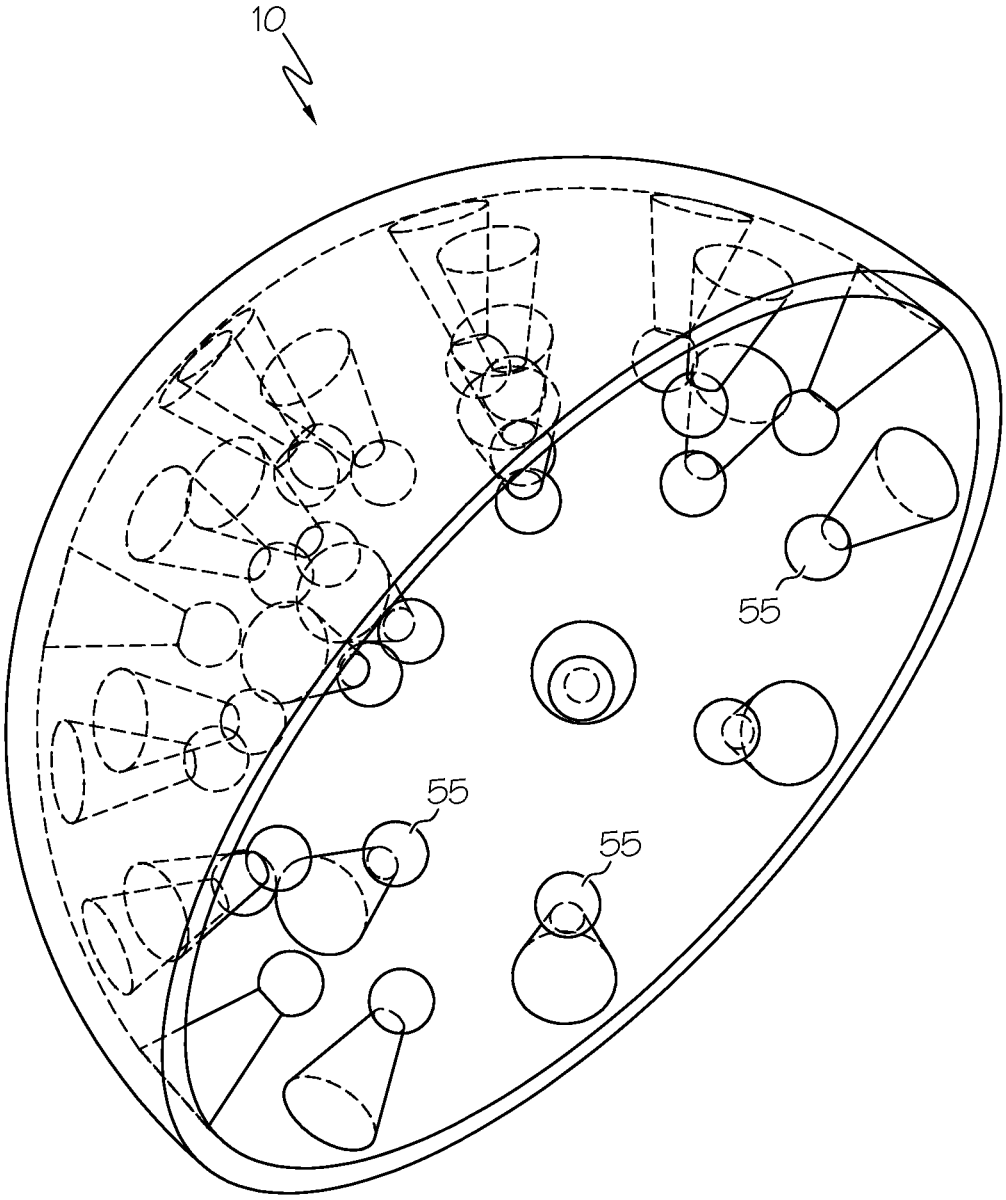
FIG. 3A shows a perspective view of the helmet, as viewed from underneath.

FIG. 3A depicts a perspective view of the helmet 10, as viewed from underneath. The standoffs 55 are attached to the underside of the helmet 10 in order to provide an air gap, or separation space, between the user's hair and the dome. The separation space will allow for more convection than if the helmet was seated directly on the hair. Also, the standoffs 55 will prevent matting of the hair while drying.

In some embodiments, the standoffs 55 are designed to be detachable to allow the helmet 10 and its contacts 30, 32, 34, and 36 to more easily mate with the base station 40 for drying and recharging. In other embodiments the pressure contacts 46 and 48 and/or the contacts 52 and 53 on the base station 40 are designed to easily mate with the helmet contacts 30, 32, 34, and 36 when the standoffs are still attached to the underside of the helmet 10.

One of ordinary skill will recognize that there are a number of suitable designs available for the standoffs 55 presented in FIG. 3A. As such, the design of the standoffs 55 in FIG. 3A is meant to be illustrative and is not meant to restrict the design of the standoffs 55 to the embodiment depicted.

Figure 4:
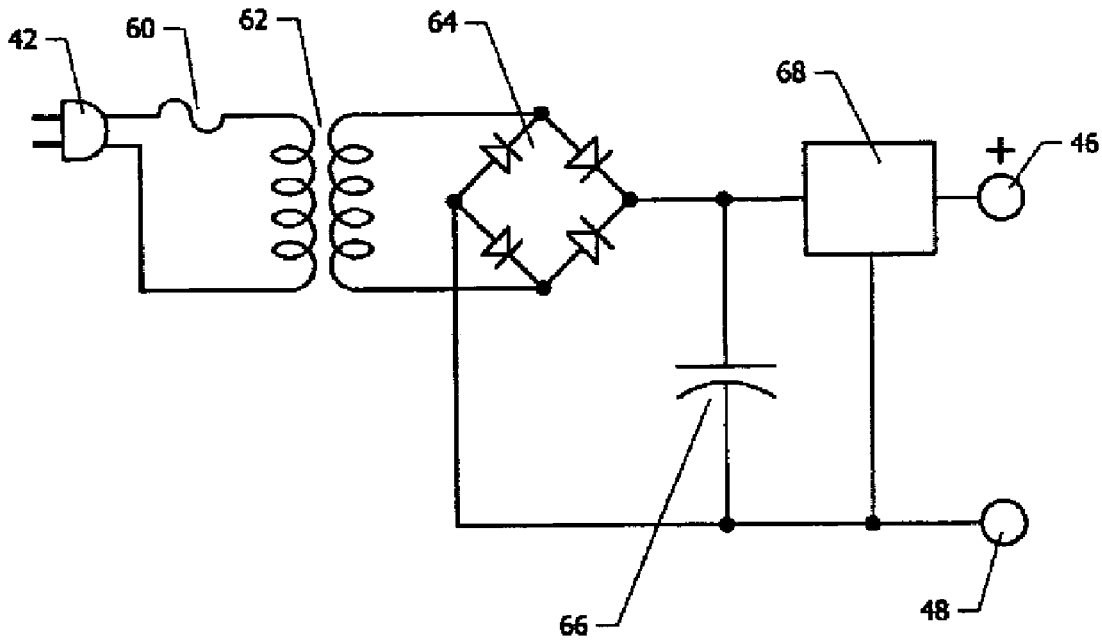
FIG. 4 shows the electronic schematic of the base station.

FIG. 4 shows the schematic for the power supply for the base unit. Power plug 42 feeds power into the unit, which is limited by fuse 60, and then to transformer 62 to reduce the voltage to approximate 12 VAC RMS. This is fully rectified by rectifier bridge 64 and then filtered by filter capacitor 66. Finally, that rectified DC power is voltage and current limited by power supply controller 68 to provide a positive 12 volts to terminal 46 with a return at terminal 48.

Figure 5:
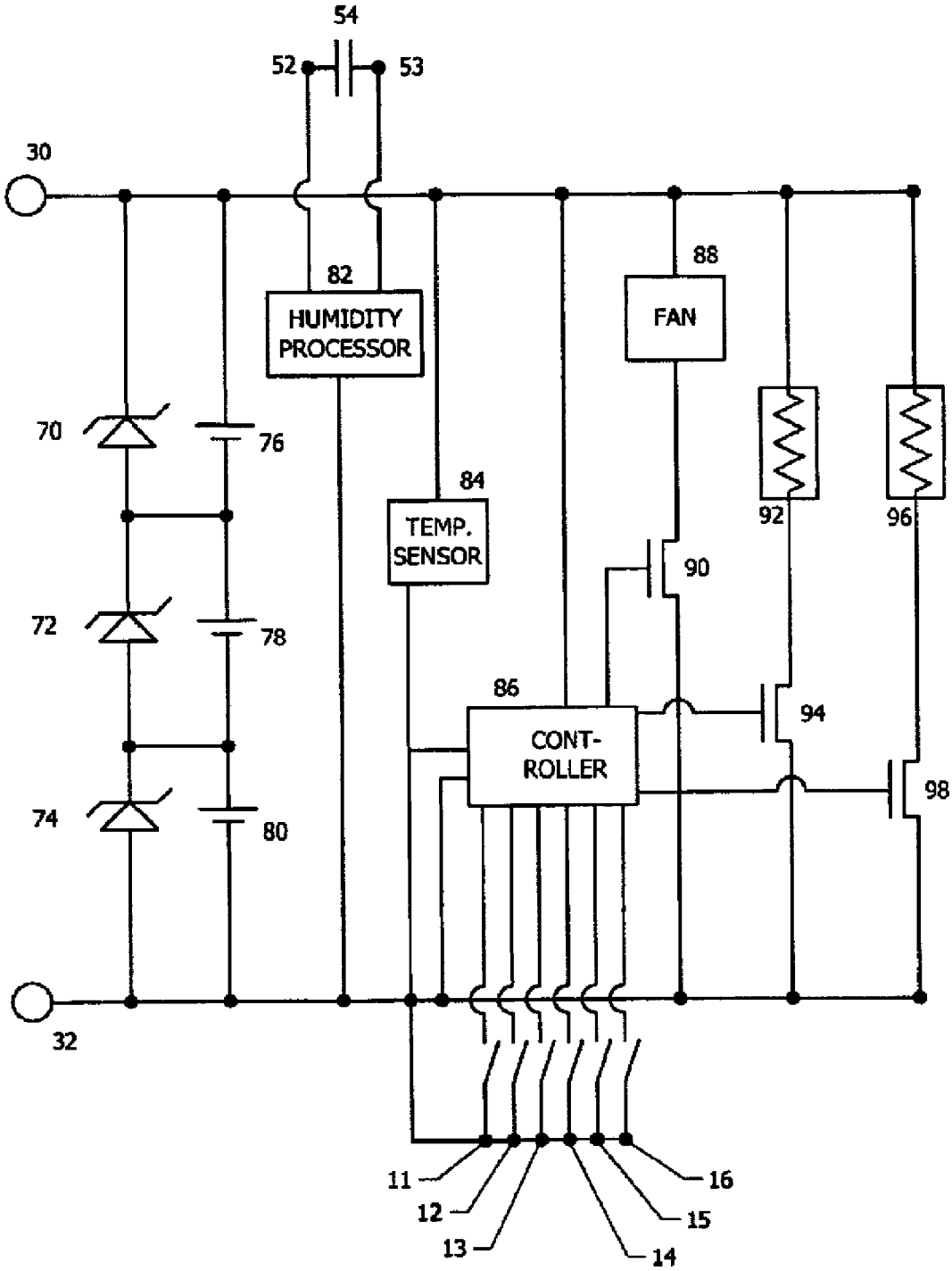
FIG. 5 shows the electronic schematic for the helmet.

FIG. 5 teaches the basic schematic of the helmet. The power is input on terminals 30 and 32 from the base station for recharging. This is then used to recharge the three battery sections in series namely lithium ion polymer cells 76, 78 and 80. Each of these is protected from overcharging by Zener diodes 70, 72, and 74 respectively.

Controller 86 performs all sensor data processing and system controls. As previously mentioned, the capacitance humidity sensor 54 is located at the bottom of the base unit in the top of the airflow from the helmet being regenerated. This type of sensor is most simply explained by the fact that a thin electric polymer layer absorbs water molecules through the very thin metal electrode and causes a capacitance change proportional to the relative humidity due to the fact that its dielectric constant changes. A device using this technology is available from Met One Instruments of Grants Pass, Oreg. or NovaLynx Corporation at novalynx.com. Suitable capacitance based humidity sensors are the APS-200 from General Eastern Instruments of Woburn, Mass. (www.geinet.com). Thus the capacitance humidity sensor will be able to sense the humidity of the air coming down from the helmet so the system will "know" when the helmet has been dried out. This capacitance value then goes into humidity processor 82 where it is converted to a DC level to be fed to the controller 86.

In an alternative embodiment, the humidity sensor is located in the helmet. This is then connected to circuitry to alert the user when then desired level of humidity had been reached. This allows the operator to dry the hair to a precise level of humidity and stop to begin styling. Alternatively, the helmet circuitry would merely stop the drying process at this point.

The temperature sensor 84 is mounted inside the phase change material. This feeds a DC voltage proportional to the temperature into the controller 86. A suitable temperature sensor is the REF 02 available from Maxim at Maxim-IC.com.

Alternatively both the humidity sensing function and the temperature sensing function may be performed by a single integrated sensor. The preferred sensor is the SHT11 from Sensirion AG of Zurich Switzerland and located at www.sensition.com.

Switches 11, 12, 13, 14, 15, and 16 control the fan speed up or down, the temperature up or down, and the on/off functions as described in FIG. 1.

Fan 88 is controlled by power MOSFET 90, which is in turn controlled by the controller 86. Nichrome heating wires 92 are controlled by power MOSFET 94, which is in turn controlled by the controller 86. Optional heating wires 96 in the air stream of the fan on top of the helmet are controlled by power MOSFET 98, which is in turn controlled by the controller 86. A suitable choice for the power MOSFETs 90, 94, and 98 is the IRF6601 from International Rectifier located at IRF.com.

Figure 6:
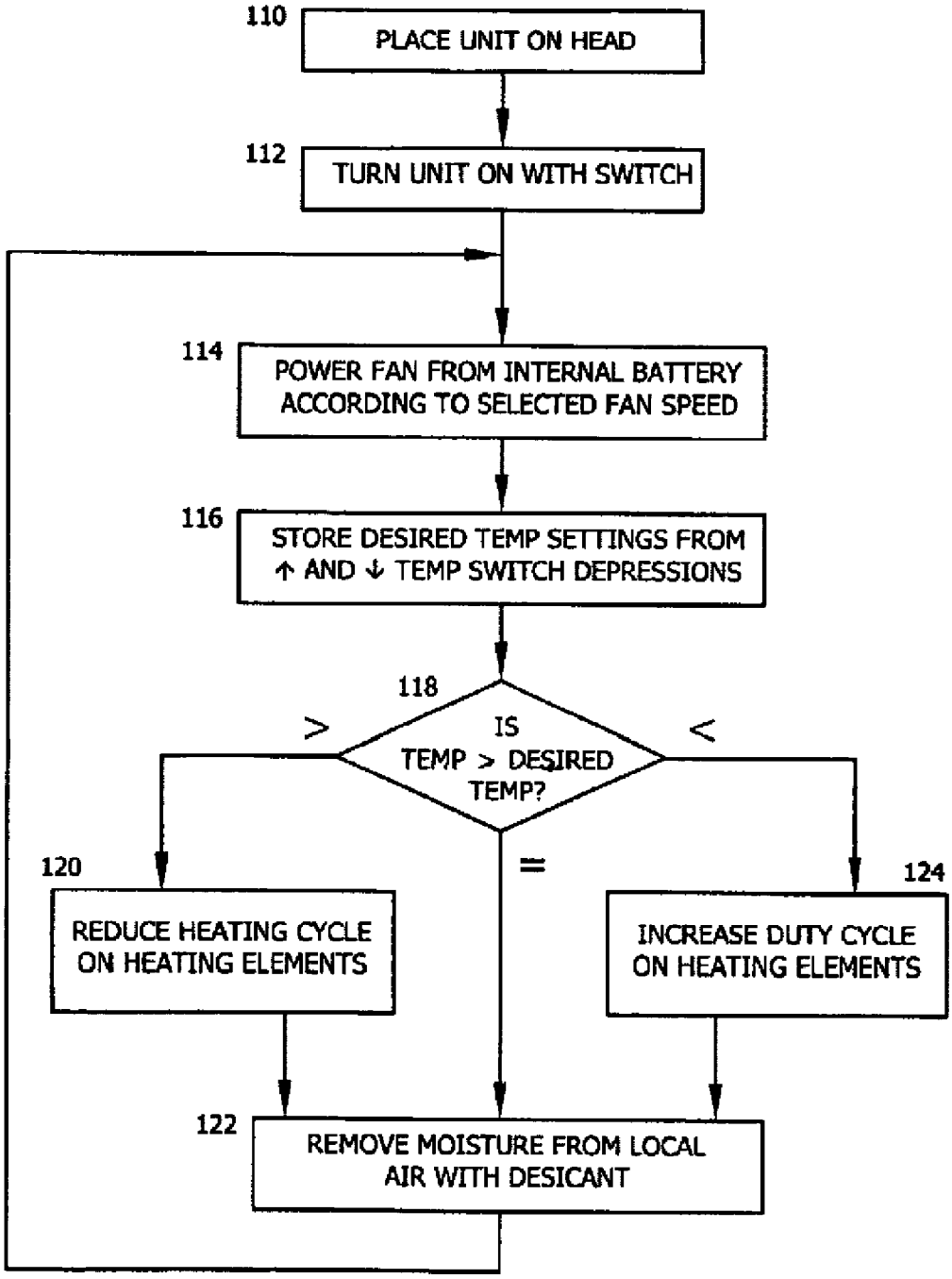
FIG. 6 shows the method for drying hair taught in this invention.

The hair drying method is explained in FIG. 6. At step 110 the operator places the helmet on the head and then turns the unit on with the switch in step 112. At step 114 the fan is powered from the internal battery according to the selected fan speed. In step 116 the controller stores the desired temperature settings from the "up" and "down" temperature switch depressions. At step 118 the controller asks if the temperature is greater than the desired temperature. If it is in fact greater than the desired temperature then the method branches to step 120 to reduce the duty cycle on the heating elements by giving shorter "on" pulses to MOSFETs 94 and 98. If the temperature is approximately equal to the desired temperature then the system progresses down to step 122, which is to remove the moisture from the local air with the desiccant. This is also where the method ends up after completing step 120. If the temperature is in fact less than the desired temperature then the system will increase the duty cycle on the heating elements in step 124. Note that the heating will be minimal at first as the method relies on the stored heat in the helmet at the beginning.

Figure 7:
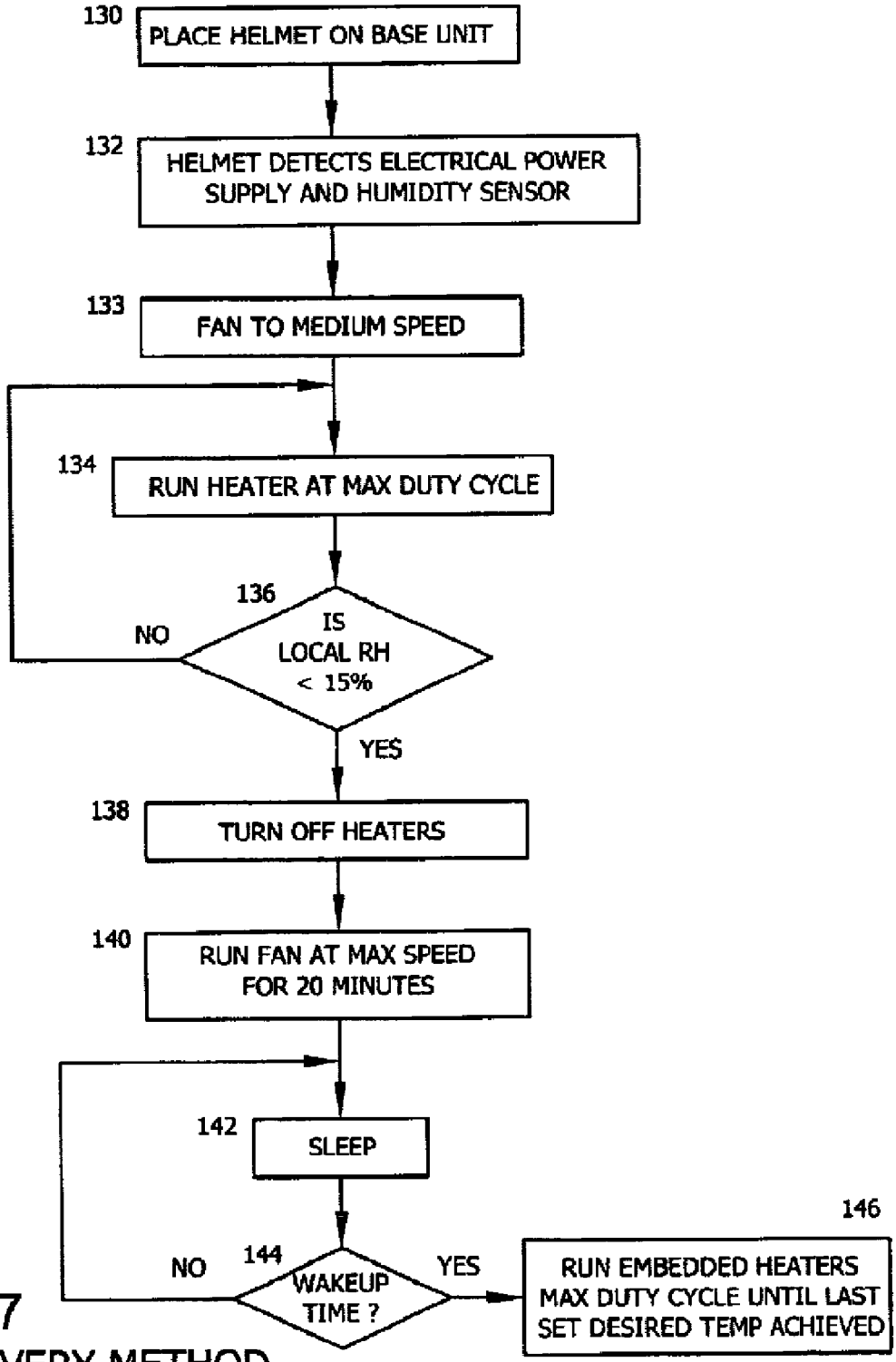
FIG. 7 shows the method for the regeneration and recovery of this invention.

FIG. 7 explains the recovery and regeneration method of the invention. In step 130 the operator places the helmet on the base unit. In step 132 the helmet detects the electrical power supply connections and the humidity sensor connections. In step 133 the system runs the fan to a medium speed. In step 134 the system runs the heater at a maximum duty cycle. The system then goes to the branch question 136 and asks if the local relative humidity is less than 15%. If it is not then the system continues to cycle through step 134.

If in fact the local relative humidity is finally brought down below 15% then we can be confident that the desiccants have dried out. At this point the method progresses to step 138 where the heaters are turned off. The method then goes to step 140 where the fan is run at maximum speed for 20 minutes.

This is because the desiccant recycling is actually a 2-step process. To begin with, dry desiccant has a low vapor pressure and the moist air coming off of the wet hair has a higher vapor pressure. Therefore the water vapor moves from the air to the desiccant to equal that pressure difference during the drying operation. As the desiccant collects water its vapor pressure and temperature rise until the vapor pressure of air and desiccant and the desiccant no longer attract water vapor. At this point the desiccant is said to be in equilibrium. Now, during the regeneration process the desiccant must be dried by heating. Heating raises the vapor pressure at the surface of the desiccant very high. This is well above the vapor pressure of the surrounding air. This is especially true because the dry dome is now replacing the wet human head. So the water moves out of the desiccant towards a lower vapor pressure in the dry air being forced over it now during the regeneration process. Now, even though the desiccant is dry its surface vapor pressure remains high because it is hot. To restore its lower vapor pressure the desiccant must be cooled. This is the point of running the fan at maximum speed as described in step 140.

At step 142 the system goes to sleep for 23 hours. At step 144 the system asks if it is wakeup time. If it is then in step 146 it runs the embedded heaters at maximum duty cycle until the set desired temperature is achieved.

The system is now ready to be used when the operator comes in to take it off of the regeneration base.

Figure 8:
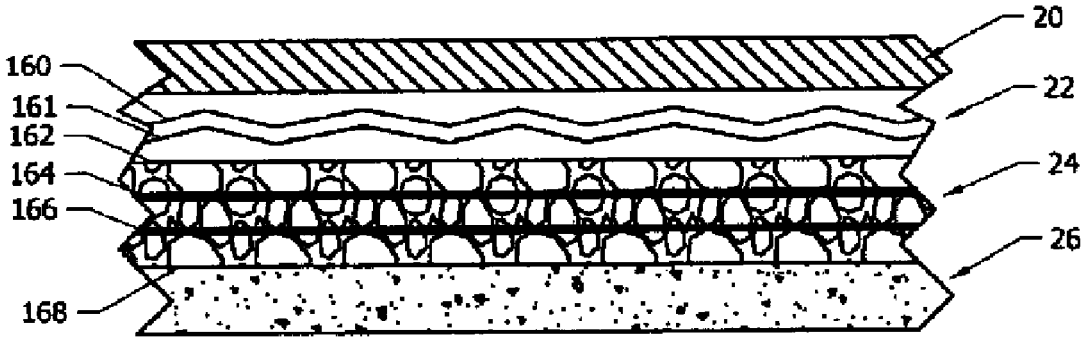
FIG. 8 shows a detailed cross section of the helmet shell.

FIG. 8 shows a detailed cross section of the shell of the helmet. Beginning on the outside is the layer 20 of thermal insulating material. Layer 22 is the phase change material as described below. However here we see the detail of two heating wires, 160 and 161 embedded in the phase change material. These serve to heat phase change material during regeneration and to maintain its temperature during operation.

Layer 24 is the lithium ion polymer battery. Details of this are the outer shell 162, the anode 164, the cathode 166, and the inner wall 168. Finally the desiccant layer 26 is shown.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A personal ambulatory hair dryer system comprising:

an approximately head-conforming shell, the shell comprising a desiccant, a phase change material for storing and releasing energy, at least one heating element, a fan, and a battery weighing less than 1 kilogram, wherein the phase change material comprises a first state and a second state, in the first state the phase change material is solid and in the second state the phase change material is liquid, wherein the battery is in electrical communication with the fan and the at least one heating element, and wherein the shell is constructed and arranged to be positioned upon a base unit, the base unit further comprising electrical contacts to recharge the battery in the shell.

2. The personal ambulatory hair dryer of claim 1, wherein the desiccant contains zeolite.

3. The personal ambulatory hair dryer of claim 1, wherein the desiccant contains silica gel.

4. The personal ambulatory hair dryer of claim 1, wherein the self-contained battery is a lithium ion battery.

5. The personal ambulatory hair dryer of claim 1, further comprising a humidity sensor mounted on either the shell or the base unit to read the local humidity to control the drying of the shell during a regeneration cycle.

6. The personal ambulatory hair dryer of claim 1, wherein the phase change material has a melting point of from about 30° C. to about 61° C.

7. The personal ambulatory hair dryer of claim 1, wherein the phase change material has a latent heat of fusion of from about 205 J/g to about 251 J/g.

8. The personal ambulatory hair dryer of claim 1, wherein the shell further comprises standoffs so that a separation space is created between the shell and the wearer's hair.

9. The personal ambulatory hair dryer of claim 1, further comprising a temperature sensor.

10. The personal ambulatory hair dryer of claim 9, wherein the temperature sensor is mounted inside the phase change material.

11. A personal ambulatory hair dryer system comprising:

an approximately head-conforming shell, the shell comprising a desiccant, a phase change material for storing and releasing energy, at least one heating element, a fan, and a lithium ion battery weighing less than 1 kilogram, wherein the phase change material comprises a first state and a second state, in the first state the phase change material is solid and in the second state the phase change material is liquid, wherein the desiccant comprises zeolite and silica gel, and wherein the battery is in electrical communication with the fan and the at least one heating element, and wherein the shell is constructed and arranged to be positioned upon a base unit, and wherein the hair dryer system further comprises a humidity sensor, a temperature sensor, standoffs, and electrical contacts to recharge the battery in the shell.

* * * * *